US011149513B2

(12) United States Patent
Scott

(10) Patent No.: US 11,149,513 B2
(45) Date of Patent: Oct. 19, 2021

(54) INTEGRATED DOUBLE-STUDDED PACK-OFF ADAPTER

(71) Applicant: Michael D. Scott, Oklahoma City, OK (US)

(72) Inventor: Michael D. Scott, Oklahoma City, OK (US)

( * ) Notice: Subject to any disclaimer, the term of this patent is extended or adjusted under 35 U.S.C. 154(b) by 0 days.

(21) Appl. No.: 16/575,536

(22) Filed: Sep. 19, 2019

(65) Prior Publication Data

US 2021/0087898 A1 Mar. 25, 2021

(51) Int. Cl.

| | |
|---|---|
| ***E21B 33/04*** | (2006.01) |
| ***E21B 33/068*** | (2006.01) |
| ***E21B 43/26*** | (2006.01) |
| ***E21B 47/00*** | (2012.01) |

(52) U.S. Cl.

CPC ..... *E21B 33/04* (2013.01); *E21B 33/068* (2013.01); *E21B 47/00* (2013.01); *E21B 43/26* (2013.01)

(58) Field of Classification Search

CPC ..... E21B 33/04; E21B 33/068; E21B 47/00; E21B 43/26

See application file for complete search history.

(56) References Cited

U.S. PATENT DOCUMENTS 4,390,186 A * 6/1983 McGee ..... E21B 33/04 277/322
4,652,022 A * 3/1987 Nichols ..... E21B 33/04 285/393
7,069,987 B2 * 7/2006 Kwasniewski ..... E21B 33/0422 166/85.3
7,308,934 B2 * 12/2007 Swagerty ..... E21B 33/068 166/177.5
8,327,943 B2 * 12/2012 Borak ..... E21B 33/037 166/368
8,950,485 B2 * 2/2015 Wilkins ..... E21B 43/26 166/281
2012/0012341 A1 * 1/2012 White ..... E21B 33/12 166/386
2015/0315869 A1 * 11/2015 Landry ..... E21B 33/04 166/86.1

FOREIGN PATENT DOCUMENTS

CA 2638434 A1 * 1/2010 ..... E21B 33/04

* cited by examiner

*Primary Examiner* — Matthew R Buck
(74) *Attorney, Agent, or Firm* — Edward L. White

(57) ABSTRACT

An integrated multi-pressure fracking adapter apparatus comprising a cylindrical body for mounting on a wellhead casing head, having an exterior circumference, an interior circumference creating a cylindrical passage perpendicular to the radius, pipe and casing seals within the cylindrical passage, a high pressure mounting surface, a low pressure mounting surface, fasteners for securing to wellhead components, an external sealing surface, and a testing port whereby a user installs an integrated multi-pressure fracking adapter in between a lower pressure casing head and a high-pressure fracking valve assembly, injects packing material, verifies the seals functionality, and begins fracking with high pressure fracking fluids thereby reducing costs of high pressure equipment and manhours involved removing and replacing the low pressure rated well head components with high pressure well head components for fracking then restoring the original components.

18 Claims, 4 Drawing Sheets

INTEGRATED DOUBLE-STUDDED PACK-OFF ADAPTER

CROSS-REFERENCE TO RELATED APPLICATIONS

None

FIELD OF THE INVENTION

The invention generally relates to oil and gas well hydraulic fracturing ("fracking") operations and specifically, a wellhead adapter for fracking assembly. In particular, the invention relates to an adapter connecting a higher-pressure fracking assembly to a lower pressure wellhead eliminating the need to replace the operating wellhead with a higher pressure assembly during fracking operations to match the pressure rating of the fracking assembly.

BACKGROUND

In completing wells or to increase hydrocarbon flow in existing wells, hydraulic fracturing is used to accomplish well stimulation. Hydraulic fracturing is a well-known well stimulation technique where the rock in the producing formation is fractured by a pressurized liquid. The process involves the high-pressure injection of "fracking fluid" into a wellbore to create cracks in the producing formations through which hydrocarbons will flow more freely. When the hydraulic pressure is removed from the well, small grains of hydraulic fracturing proppants hold the fractures open thus increasing the flow.

During normal drilling operations, a lower pressure wellhead casing is normally installed, and the well is completed. Previously, if the operator determined that fracking was necessary to enhance the flow hydrocarbons, then the lower-pressure wellhead casing, typically a 5,000 psi ("5k"), was replaced with a high-pressure wellhead casing. For example, the operator may use a 15,000 psi ("15k") fracking valve assembly for fracking the well and would need a matching 15k wellhead casing to prevent potential safety issues that may be caused by a dissimilar pressure rated wellhead casing, such as the 5k wellhead casing. To mate the high-pressure fracking valve assembly to the high-pressure wellhead casing, a standard double-studded adapter, capable of handling the high pressures, may be used. The standard double-studded adapter interfaces a similar rated wellhead flange to a fracking valve assembly flange creating a sealed area from the casing head to the frack valve assembly allowing the production tubing to pass from the wellhead casing through the standard double-studded adapter into the fracking valve assembly without any sealing between inner circumference of the standard double-studded adapter and the production pipe. A tubing head is attached to the production tubing along with a sealing assembly.

American Petroleum Institute (API) standards govern the petroleum industry and drive the safety requirement that there be a sealing capability between dissimilar pressure rating ranges. High pressure oilfield equipment, such as a high-pressure wellhead casing and double-studded adapter tend to be costly to purchase when only occasionally used, so the high-pressure oilfield equipment is typically rented from oil field service companies at a significant cost. In addition to the cost of buying or renting the high-pressure oilfield equipment, there are several other significant costs including the missing production time need to switch out 5K for 15K wellhead casings and the manpower costs to do the work. During the down time, when the wellhead casings are changed for fracking operations and returned back to the original configuration for production, the operator is not able to produce hydrocarbons and may lose significant revenue during this down time. Significant manpower costs are involved in replacing the low-pressure casing head with the high-pressure casing head and then re-installing the low-pressure wellhead casing after the fracking operations due to the amount of time and the additional steps of testing and verifying the well is safe for operations.

SUMMARY OF THE INVENTION

The present invention overcomes these shortcomings by providing an integrated double-studded pack-off adapter that allows the original the lower pressure rating wellhead casing to be used with a higher pressure rated fracking valve assembly by eliminating the removal and reinstallation of the lower pressure wellhead casing. The integrated double-studded pack-off adapter integrates a double-studded adapter and a pack-off into a single unit which allows the lower pressure wellhead casing to be removably affixed to higher-pressure fracking valve assembly via the integrated double-studded pack-off adapter. The production tubing substantially fills the adapter passage where multiple seals engage the production tubing and each seal allows the next higher-pressure rating to be used during the fracking process. In the present embodiment, the seal configuration allows a two-pressure rating differential between wellhead casing adapter and fracking assembly. That is, the invention allows the use of a 5K wellhead casing adapter and a 15k fracking assembly. The first pressure rating differential being from 5K to 10K and the second from 10K to 15K.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

Figure 1:
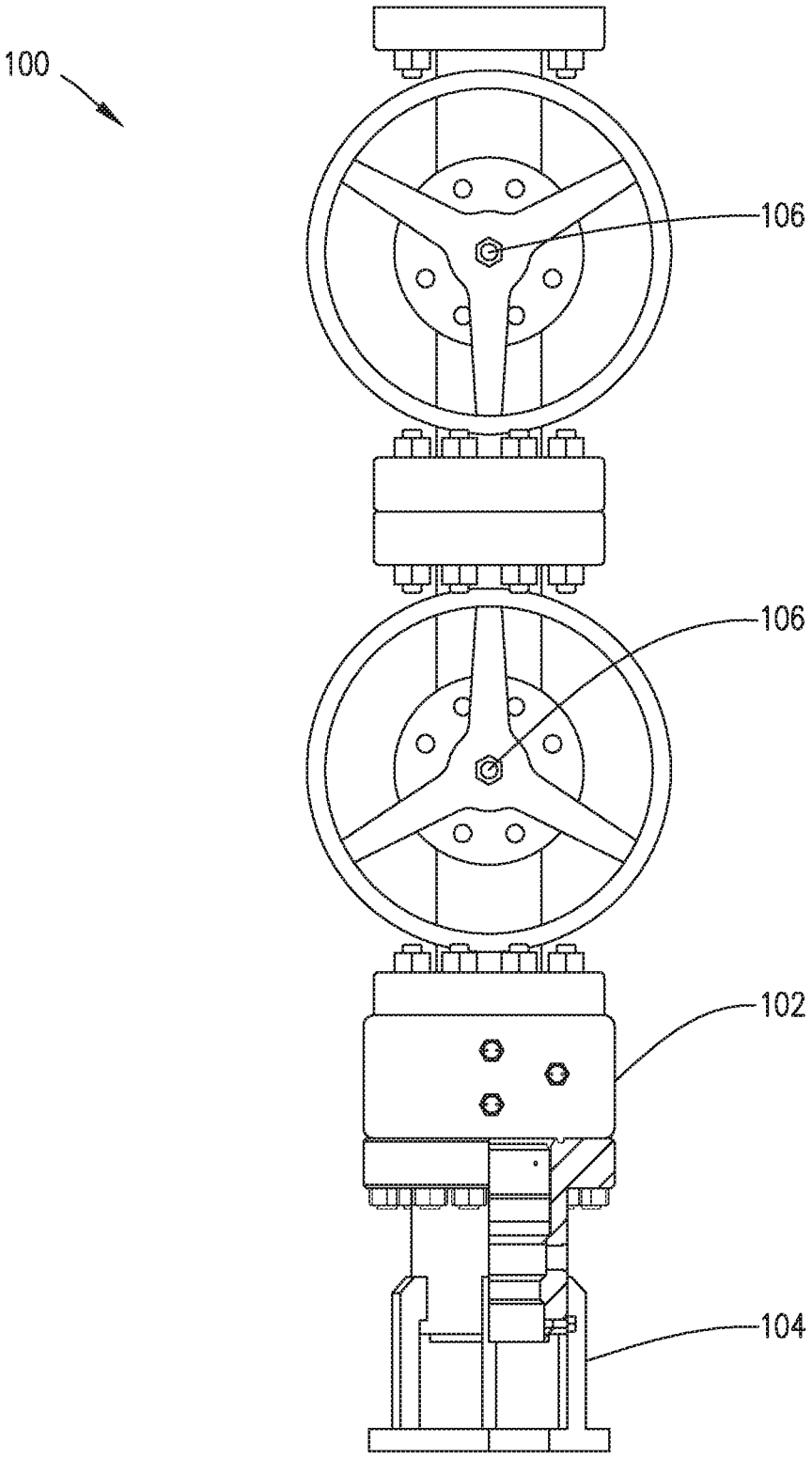
FIG. 1 is a side view, with the casing head half in longitudinal cross-section, of the fracking wellhead assembly showing the integrated double studded pack-off adapter.

As shown in FIG. 1, the integrated double-studded pack-off adapter 102 is positioned below fracking valve assembly 106 and above the casing head 104 where it removably affixes these components together in a single assembly. The integrated double-studded pack-off adapter 102 may comprise several mating surfaces and attachment points for removably affixing a fracking valve assembly and a casing head together, a series of inner seals allowing for multiple pressure rating differentials, a series of packing ports to assist with sealing, and a series to test ports. The embodiment described below has a two-pressure rating differential allowing a lower pressure casing head to be used with a higher-pressure fracking valve assembly. API standards govern the petroleum industry and drive the safety requirement for sealing between pressure rating ranges and being able to test that the seals are functioning properly. Additional seals, packing ports and test ports may be added by one skilled in the art to increase the number of pressure rating differentials desired.

In the preferred embodiment, a 5k casing head 104 is used with a 15k fracking valve assembly 106 through the integrated double-studded pack-off adapter 102. The integrated double-studded pack-off adapter 102 eliminates the need to remove, replace, and reinstall the 5k casing head with a 15k casing head, thus eliminating the equipment rental or purchase costs, the production downtime costs, and the manpower costs. The integrated double-studded pack-off adapter 102 allows an operator to more quickly and efficiently conduct fracking operations and keep the well in production longer with a faster return to service.

FIG. 1 is aside view of a wellhead fracking assembly 100 with a half-longitudinal view of a casing head 104. The wellhead fracking assembly 100 preferably comprises a casing head 104, a fracking valve assembly 106 and an integrated double-studded pack-off adapter 102. The integrated double-studded pack-off adapter 102 creates pressure-differential interface between fracking valve assembly 106 that may have twice or three times the pressure rating of the casing head 104, allowing for high-pressure fracking fluid to be pumped into the wellbore without changing the casing head 104 to a casing head with the same pressure rating as the fracking valve assembly 106. In this embodiment, the integrated double-studded pack-off adapter 102 allows one skilled in the art to install a standard casing head 104, with a 5k pressure rating, during the initial drilling and/or operation of the of the wellbore. Otherwise, the operator installs a 5k casing head for drilling operations but after the drilling is complete the standard casing head 104 is replaced with a higher-pressure casing head to match the pressure of the fracking valve assembly 106 before fracking operations may commence. Many drilling operators may not own higher pressure casing heads and must rent or buy them from wellhead and pressure control component suppliers. After fracking, the more expensive higher-pressure casing head is removed and replaced with the standard casing head 104 for production operations. The integrated double-studded pack-off adapter 102 allows the operator to forego removal and replacement before and after fracking operations, which saves the operator time and money not having to remove, replace and reinstall the casing head 104. Additionally, the operator no longer must rent or buy the similarly rated pressure casing head to match the fracking valve assembly 106.

Figure 2:
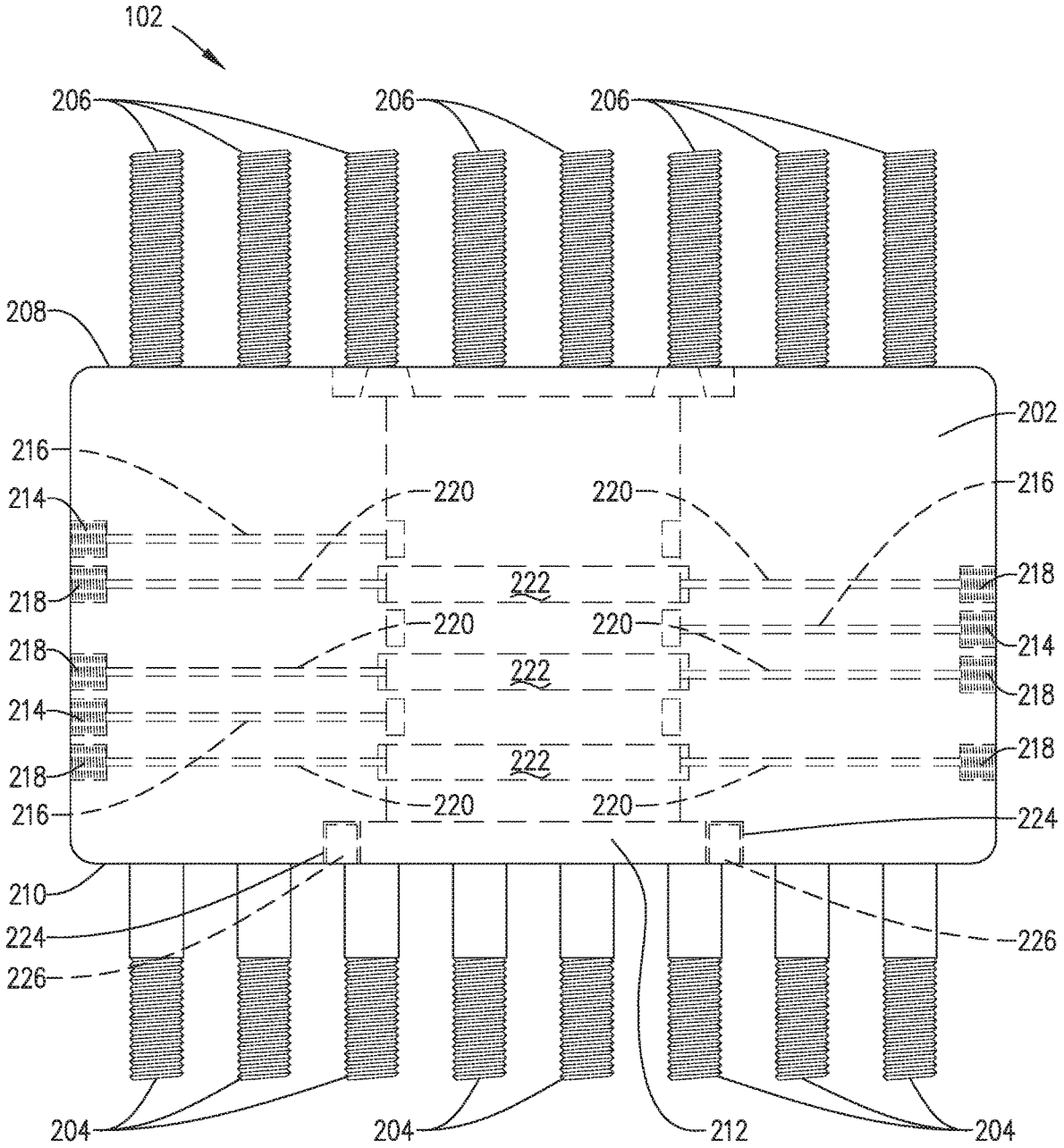
FIG. 2 is a side view of an integrated double-studded pack-off adapter.

FIG. 2 is a view of the integrated double-studded pack-off adapter side 200. The integrated double-studded pack-off adapter 102 may comprise a cylindrical body 202 with a pipe passage 212 extending through and centered within the cylindrical body 202 with a high-pressure mounting surface 208 with frack assembly studs 206 extending up therefrom, a low-pressure mounting surface 210 with casing head studs 204 extending down therefrom, an external test port 214, an external packing port 218 and a plurality of seal grooves 222. The fracking assembly studs 206 are rigidly affixed, perpendicular and extend upward from the high-pressure mounting surface 208 of the integrated double-studded pack off adapter 102. The fracking assembly studs 206 are of sufficient length to protrude through the fracking valve assembly and enable a fastener or fasteners to cooperatively engage the threaded portion of the fracking assembly studs 206 to secure the fracking valve assembly 106 to the integrated double-studded pack-off adapter 102. The fracking assembly studs 206 may be constructed from high tensile strength material known to one skilled in the art. One skilled in the art may determine the number of fracking assembly studs 206 needed for the integrated double-studded pack-off adapter 102 based on the fracking valve assembly pressure rating and the API Standards.

The casing head studs 204 are rigidly affixed, perpendicular and extend downward from the low-pressure mounting surface 210 of the integrated double-studded pack-off adapter 102. The casing head studs 204 are of sufficient length to protrude through the casing head 104 and enable a fastener or fasteners to cooperatively engage the threaded portion of the casing head studs 204 to secure the casing head 104 to the integrated double-studded pack-off adapter 102. The casing head studs 204 may be constructed from high tensile strength material known to one skilled in the art. One skilled in the art may also determine the number of casing head studs 204 needed for the integrated double-studded pack-off adapter 102 based on the casing head pressure rating and the API Standards.

In the preferred embodiment, this view illustrates the external test port 214 and the external packing port 218. Both the external test port 214 and the external packing port 218 may be threaded to receives a threaded test check valve 412 and a threaded packing check valve 410. Other methods known to one skilled in the art may be used to removably affix the check valves 410, 412 to the ports 214, 218. The external test port 214 is fluidly connected to the test port passage 216 that terminates inside of the pipe passage 212. In the current embodiment, there are three external test ports 214 and the associated test port passages 216 that extend into the pipe passage 212 between the seals. This is further explained below in FIG. 4. In the preferred embodiment, there are six external packing ports 218 that are fluidly connected to the packing port passage 220 that exit into in the inner seal grooves 222 inside the pipe passage 212 capable of receiving packing material externally and transmitting the material to the pipe passage 212. The external packing ports 218 function are described further in FIG. 4 below.

In preparation for fracking operations, the above-described components are assembled to prepare the well for fracking. Before lowering integrated double-studded pack-off adapter 102 onto the casing head 104, a lower seal 226 is placed in the lower seal race 224 of the integrated double-studded pack-off adapter 102. This lower seal 226 may substantially fill and extend outward from the lower seal race 224. After the lower seal 226 placement, the integrated double-studded pack-off adapter 102 is lowered around the fluted mandrel tail pipe 422 with the fluted mandrel tail pipe 422 passing through the pipe passage 212 and onto the casing head 104 where the casing head studs 204 cooperatively engage corresponding holes in the casing head 104. An operator may securely fasten the integrated double-studded pack-off adapter 102 to the casing head 104 by fasteners engaging threaded casing head studs 204 and tightened to a desired torque specification as determine by the API standards and/or one skilled in the art based on the operating conditions. As the fasteners are engaged, lower seal 226 is compressed to create a seal between the integrated double-studded pack-off adapter 102 and the casing head 104.

The operator may then lower and secure the fracking valve assembly 106 to the integrated double-studded pack-off adapter 102. Before lowering the fracking valve assembly 106 onto the integrated double-studded pack-off adapter 102, an upper seal 304 may be placed in the upper seal race 302 of the integrated double-studded pack-off adapter 102. This upper seal 304 may substantially fill and extend outward from the upper seal race 302. After the upper seal 304 placement, the fracking valve assembly 106 is lowered onto the integrated double-studded pack-off adapter 102 where the fracking assembly studs 206 cooperatively engage corresponding holes in the fracking valve assembly 106. An operator may securely fasten the integrated double-studded pack-off adapter 102 to the fracking valve assembly 106 by fasteners engaging threaded fracking assembly studs 206 and tightened to a desired torque specification as determine by the API standards and/or one skilled in the art based on the operating conditions. As the fasteners are engaged, upper seal 304 is compressed to create a seal between the integrated double-studded pack-off adapter 102 and the fracking valve assembly 106.

Figure 3:
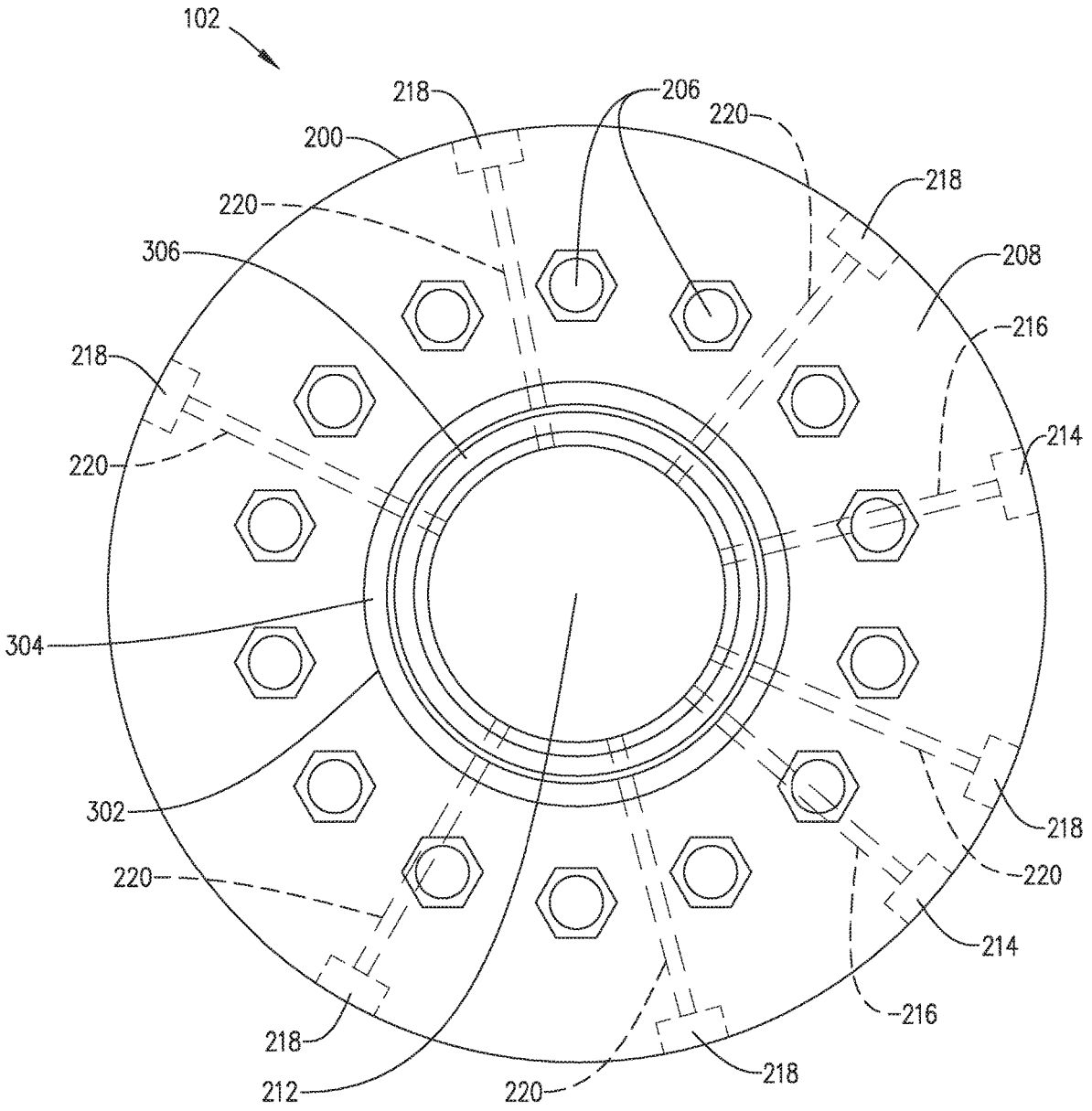
FIG. 3 is top view of an integrated double-studded pack-off adapter.

FIG. 3 is a view of the integrated double-studded pack-off adapter top 300. The integrated double-studded pack-off adapter top 300 may comprise a high-pressure mounting surface 208, an upper seal race 302, an upper seal 304, a drill guide 306 and a plurality of fracking assembly studs 206. As described earlier the high-pressure mounting surface 208 has fracking assembly studs 206 rigidly affixed and perpendicular to the high-pressure mounting surface 208. These fracking assembly studs 206 may be evenly spaced and with sufficient distance from the center of the pipe passage 212 to be compatible with standard wellhead fracking assemblies 106. One skilled in the art would understand the standard configurations for mating different wellhead components together and any standard configurations required by the API.

The upper seal race 302 is concentric outside the pipe passage 212 and extends furthest from the center of the pipe passage 212. Preferably, the upper seal race 302 is a recessed concentric track portion of the high-pressure mounting surface 208 having a width and depth to accommodate an upper seal 304. However, one skilled in the art may select other known types of seals and their corresponding seal races for sealing the high-pressure mounting surface 208. The upper seal race 302 may receive and engage a bottom and side of the upper seal 304 and the frack valve assembly 106 may engage the top portion of the upper seal 304. The seal is positioned between the high-pressure mounting surface 208 of the integrated double-studded pack-off adapter 102 and the frack valve assembly 106 creating a pressure seal around the pipe passage 212 to prevent any hydrocarbons from escaping.

The drill guide 306 is concentric inside the upper seal race 302 and outside pipe passage 212 and at the outer edge of the pipe passage 212. The drill guide 306 may start at the same height as the high-pressure mounting surface 208 and then slope downward toward the pipe passage 212 where the drill guide 306 terminates at the edge of the pipe passage 212 thus creating a slanted shoulder such that as the drill is lowered toward the pipe passage 212 the drill guide 306 funnels the drill into the pipe passage 212 to continue operations. This drill guide 306 may allow the operator more easily continue drilling operations when reinstalling the drill and the associated pipe.

This view illustrates the external test ports 214 and their associated test port passages 216. The external test ports 214 in the preferred embodiment are perpendicular to the outer cylindrical surface of the integrated double-studded pack-off adaptor 102. The test port passages 216 radiate from the center pipe passage 212 to the external test ports 214, fluidly connecting the pipe passage 212 to the external test ports 214. This view only shows two external test ports 214 because the third external test port 214 may be underneath and directly aligned with one of the other external test ports 214.

In this preferred embodiment, the external packing ports 218 are perpendicular to the outer cylindrical surface of the integrated double-studded pack-off adaptor 102. The packing port passages 220 radiate from the center pipe passage 212 to the external packing ports 218, fluidly connecting the pipe passage 212 to the external test ports 214. Preferably, there are two external packing ports 218 and passages 220 for each inner seal. However, one skilled in the art may desire to place additional external packing ports 218 and passages 220 for additional control of the insertion of packing material behind the inner seals.

Figure 4:
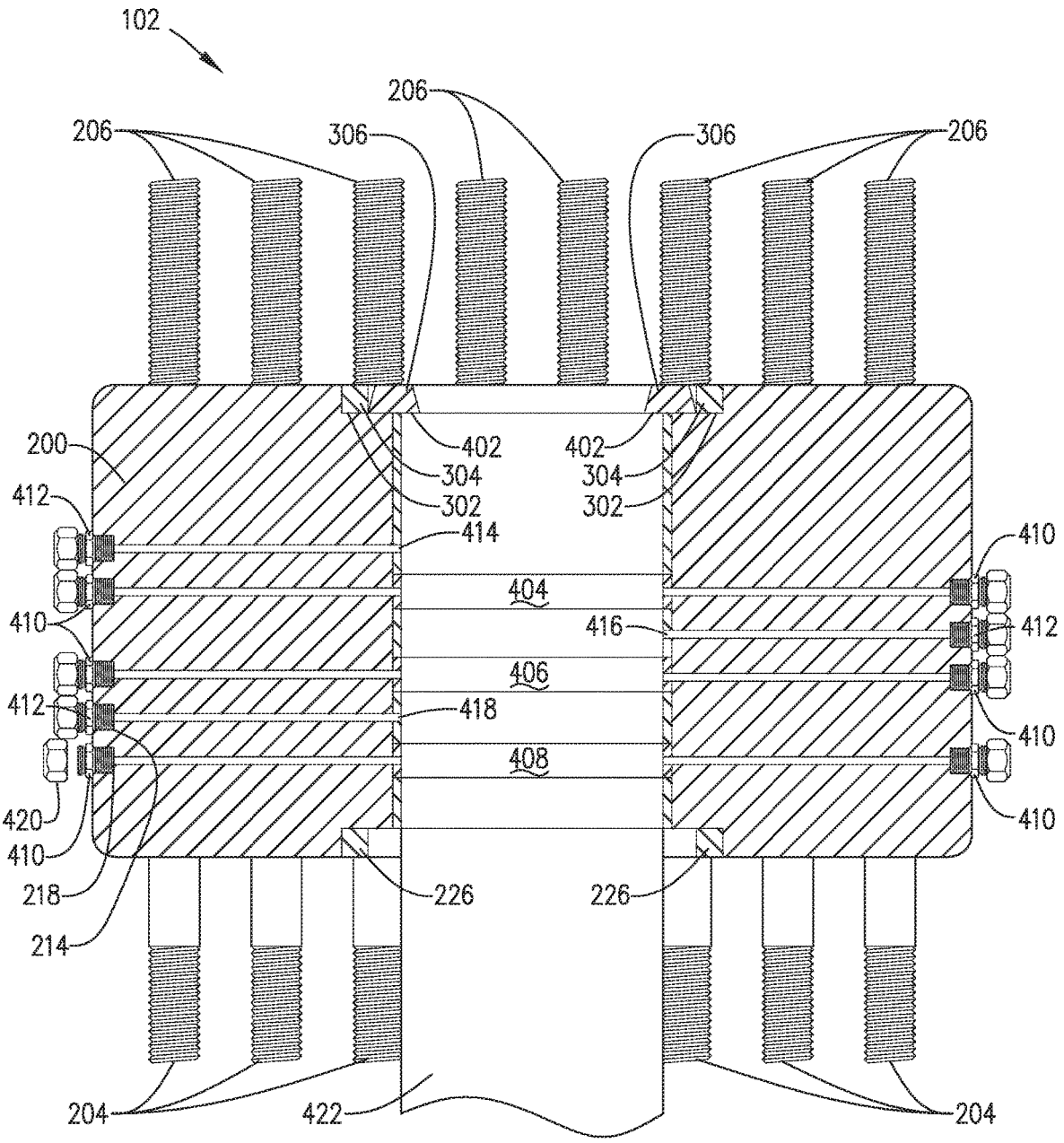
FIG. 4 is cross-sectional view of the integrated double-studded pack-off adapter.

FIG. 4 is a view of the integrated double-studded pack-off adapter cross section 400 with a fluted mandrel extended neck 422 positioned inside the adapter 102. In the preferred embodiment the integrated double-studded pack-off adapter 102 further comprises a shoulder 402, an upper inner seal 404, a middle inner seal 406, a lower inner seal 408, packing check valves 410, test check valves 412, an upper test port opening 414, a middle test port opening 416, and a lower test port opening 418. As the integrated double-studded pack-off adapter 102 is lowered onto the casing head 104 the fluted mandrel extended neck 422 extends through the pipe passage 212 and through a series of inner seals 404, 406, and 408 and may engage the shoulder 402 in the integrated double-studded pack-off adapter 102. The shoulder 402 may prevent the fluted mandrel extended neck 422 from exiting the pipe passage 212 and damaging the fracking valve assembly 106 or injuring personnel.

There is a sealed area defined between each of the inner seals 404, 406 and 408. The pressure in each of the sealed areas can be measured by way of test port openings 414, 416 and 418.

As described above, the fluted mandrel extended neck 422 extends through the pipe passage 212 where it is surrounded by a series of stacked inner seals including an upper inner seal 404, a middle inner seal 406, and a lower inner seal 408. In the preferred embodiment, the inner seals 404, 406, 408 are positioned within and engage three stacked inner seal grooves 222 that have been created in the sidewall of the pipe passage 212. The external packing ports 218 are fluidly connected to the inner seal grooves 222 through the packing port passages 220. Preferably, after the integrated double-studded pack-off adapter 102 has been installed over the fluted mandrel extended neck 422, the inner seals 404, 406, and 408 may engage the fluted mandrel extended neck 422 to create three sealed zones.

The external test ports 214 and the external packing ports 218 ports described earlier in FIG. 2 preferably have threads allowing them to removably receive an engage the packing check valves 410 and the test check valves 412. The packing check valves 410 allow the injection of sealing material and the test check valves 412 allow pressurizing the sealed areas for functionality checks. Check valve caps 420 may be placed on the outside of the check valves 410 and 412 to prevent any inadvertent release of packing material and/or pressure due to a check valve failure. The check valve caps 420 may prevent dirt and debris from entering the check valves 410 and 412 and potentially cause the check valves 410 and 412 to fail.

An operator may create the sealed zones by externally applying packing material to the packing check valves 410 where the packing material communicates pressure through the packing port passages 220 into the inner seal grooves 222 behind the selected seal. The expanding packing material and the associated seal engage the fluted mandrel extended neck 422 to form a tight seal. Preferably, two external packing ports 218 and packing port passages 220 are positioned radially and on opposing sides of the selected inner seal groove 222, which allows for one skilled in the art to insert packing material into the inner seal groove 222 from opposing sides for complete coverage all the way around the inner seal groove 222. In the preferred embodiment, the three inner seal grooves 222 have packing material inserted into six external packing ports 218 and six packing port passages 220, two for each inner seal groove 222, creating three sealed areas within the pipe passage 212. Two of the sealed areas may be between the fluted mandrel extended neck 422 and the integrated double-studded pack-off adapter 102 and the other sealed area the fracking valve assembly 106 within the pipe passage 212. A first sealed area is created between the lower inner seal 408, the middle inner seal 406, the fluted mandrel extended neck 422, and pipe passage 212. A second sealed area is created between the middle inner seal 406, the upper inner seal 404, the fluted mandrel extended neck 422, and pipe passage 212. A third sealed area is created between the upper inner seal 404, the pipe passage 212, and the fracking valve assembly 106.

Once the inner seals 404, 406, and 408 and the packing material have engaged the fluted mandrel extended neck 422, a pressure check may be required for each sealed area between each of the inner seals 404, 406, and 408 to verify the areas have correctly sealed. An operator may verify proper sealing using a series of test port openings between the seals 404, 406, and 408 including an upper test port opening 414, a middle test port opening 416 and a lower test port opening 418. The sealed area between the fracking valve assembly 106 and the upper inner seal 404 may be tested to verify no leaks exist by pressurizing the area between the inner upper seal 404 and a fracking valve assembly 106 to a desired pressure and in the preferred embodiment the desired pressure is at least 5k psi. One skilled in the art may select other pressures based on well operating conditions and fracking operations. The operator applies the desired pressure to the test check valve 412 removably affixed to the external test port 214 that transmits the pressure through test port passage 216 to the upper test port opening 414 inside the pipe passage 212 thus pressurizing the sealed area. The area between fracking valve assembly 106 and the upper inner seal 404 is preferably pressurized to and maintained at 5k psi for a sufficient time determined by the operator to detect a potential leak. If no leak is detected between the upper inner seal 404 and the fracking valve assembly 106 that area is sufficiently sealed to with stand pressures up to the test pressure. Next the operator may test the sealed area by applying test pressure between the upper inner seal 404 and the middle inner seal 406 using the same process of pressurizing the sealed area as described above to detect any leaks at the desired pressure. If no leak is detected between the upper inner seal 404 and middle inner seal 406 that test area is sufficiently sealed to with stand pressures up to the test pressure. If there are leaks that indicates the seals and packing did not properly engage sealed area is not fully functional and should be corrected to withstand the test pressure. Finally, the lower inner seal 408 and the middle inner seal 406 may be tested to verify the seals 406 and 408 have properly engaged the fluted mandrel extended neck 422 and the integrated double-studded pack-off adapter 102 and are functional.

Each inner seal 404, 406, and 408 may be rated to withstand at least a 15k psi differential. The API standard may suggest a single seal should be used to separate two pressure ranges where the pressure differential is circa 5k psi and testing ports between the differing pressure ranges to verify the integrity of the seal. In the preferred embodiment, there is a 10k psi rating differential between the casing head 104 and the fracking valve assembly 106. While a single inner seal is sufficient to withstand this 10k psi differential, preferably two additional inner seals are used in conjunction with the first inner seal to provide additional redundancy for safety in case of a single seal failure to protect the lower rated casing head 104. If multiple pressures ranges are traversed, a requisite number of seals may be required to position a seal between the multiple dissimilar pressure ranges with corresponding testing ports to verify the seals' integrity.

Having thus described the invention, I claim:

1. An integrated multi-pressure fracking adapter for direct engagement with a casing string, the adapter comprising:

a. a cylindrical body for mounting on a well casing head having—
   i. an exterior circumference,
   ii. an interior circumference creating a cylindrical passage perpendicular to the radius,
   iii. a sealing means for sealing the casing string within the cylindrical passage,
   iv. at least one high pressure mounting surface, and
   v. at least one low pressure mounting surface;

b. a fastening means for affixing the high-pressure mounting surface to a fracking valve assembly and the low-pressure mounting surface to the casing head;

c. at least one external sealing surface; and d. at least one testing means for testing the sealing means;

whereby a user installs the integrated multi-pressure fracking adapter between a lower-pressure casing head and a high-pressure fracking valve assembly, injects packing material, verifies the sealing means' functionality, and begins fracking with high pressure fracking fluids thereby reducing costs of high pressure equipment and man hours involved removing and replacing low pressure rated well head components with high pressure well head components for fracking then restoring the low pressure rated well head components.

2. The adapter of claim 1 where the adapter has an interior pipe shoulder preventing the pipe from exiting a top of the adapter.

3. The adapter of claim 1, where the adapter has a drill guide at the top entrance to the interior cylindrical passage.

4. The adapter of claim 1, where the adapter has a seal race on the high pressure mounting surface.

5. The adapter of claim 1, where the adapter has a seal race on the low pressure mounting surface.

6. The adapter of claim 1, where the adapter has a series of seal grooves in the wall of the cylindrical passage defining multiple sealed zones.

7. The adapter of claim 6 with more than two sets of seals creating at least two internal sealed zones thus adapted to allow at least three 5K pressure steps above atmospheric pressure.

8. The adapter of claim 7, having a corresponding set of external ports fluidly connected to the inner passage with an external valve for receiving sealing material and transferring the material to the inner passage.

9. The adapter of claim 1, where the sealing means is selected from a group of metal, elastomer, and tetrafluoroethylene.

10. The adapter of claim 1, where the fastening means are selected from a group of bolts, studs, and threaded rod.

11. The adapter of claim 1, where the adapter further comprises a series of test ports for testing sealed areas defined between adjacent seals of the sealing means.

12. The adapter of claim 11, where each of the test ports is threaded to receive a removable check valve to receive and maintain the pressure on the sealing means in the adapter.

13. The adapter of claim 11, where each of the test ports is fluidly connected to the cylindrical passage.

14. The adapter of claim 1, where the adapter further comprises a series of external packing ports for injecting packing material into the adapter.

15. The adapter of claim 14, where each of the external packing ports is threaded to receive a removable check valve to receive and maintain the packing material in position in the adapter.

16. The adapter of claim 14, where each of the external packing ports is fluidly connected to the cylindrical passage.

17. An integrated multi-pressure fracking adapter comprising:

a. a cylindrical body for mounting on a well casing head having— i. an exterior circumference, ii. an interior circumference creating an inner passage perpendicular to the radius, iii. at least one inner seal groove formed inside the passage in the interior circumference, iv. a high-pressure mounting surface, v. at least one seal groove on the high-pressure mounting surface, vi. a low-pressure mounting surface, and vii. at least one seal groove on the low-pressure mounting surface;

b. a plurality of threaded studs having a length to engage the casing head with the low-pressure mounting surface;

c. at least one elastomeric inner seal;

d. at least one seal on the high-pressure mounting surface;

e. at least one test port fluidly connecting an exterior surface of the exterior circumference to the inner passage and exiting adjacent the at least one inner seal;

f. a plurality of check valves to test and engage the at least one inner seal; and g. an external port fluidly connected to the inner passage with an external valve for receiving sealing material and transferring the material to the inner passage, whereby a user installs the integrated multi-pressure fracking adapter between a lower-pressure casing head and a high-pressure fracking valve assembly, where the at least one inner seal and a pipe shoulder engage a tubing string within the inner passage, tests the at least one inner seal in the adapter using the at least one test port to verify the at least one inner seal's functionality, add additional sealing material as required and begin fracking with high pressure fracking fluids thereby reducing costs of high pressure equipment and manhours involved removing and replacing low pressure rated well head components with higher pressure well head components for fracking then restoring the low pressure rated well head components.

18. The adapter of claim 17, where a connection to the check valves is selected from threaded connection and quick disconnect.

* * * * *